US012428210B2

(12) United States Patent
Berroa García

(10) Patent No.: US 12,428,210 B2
(45) Date of Patent: Sep. 30, 2025

(54) CAPPING DEVICE INTENDED TO BE ATTACHED TO THE NECK OF A CONTAINER

(71) Applicant: BETAPACK, S.A.U., Irun (ES)

(72) Inventor: Francisco Javier Berroa García, Irun (ES)

(73) Assignee: BETAPACK, S.A.U., Irun (ES)

( * ) Notice: Subject to any disclaimer, the term of this patent is extended or adjusted under 35 U.S.C. 154(b) by 182 days.

(21) Appl. No.: 18/261,095

(22) PCT Filed: Jan. 10, 2022

(86) PCT No.: PCT/EP2022/050327
§ 371 (c)(1),
(2) Date: Jul. 11, 2023

(87) PCT Pub. No.: WO2022/152647
PCT Pub. Date: Jul. 21, 2022

(65) Prior Publication Data

US 2024/0083643 A1 Mar. 14, 2024

(30) Foreign Application Priority Data

Jan. 12, 2021 (EP) ..... 21382010

(51) Int. Cl.
*B65D 55/16* (2006.01)
*B65D 41/34* (2006.01)

(52) U.S. Cl.
CPC ..... *B65D 55/16* (2013.01); *B65D 41/3447* (2013.01); *B65D 2251/1008* (2013.01); *B65D 2401/30* (2020.05)

(58) Field of Classification Search
CPC ..... B65D 55/16; B65D 41/3447; B65D 2251/1008; B65D 2401/30
See application file for complete search history.

(56) References Cited

FOREIGN PATENT DOCUMENTS

| | | | | |
|---|---|---|---|---|
| ES | 1232089 U | | 7/2019 | |
| FR | 3094353 A1 | | 10/2020 | |
| WO | WO2020008092 A1 | | 1/2020 | |
| WO | WO-2020193821 A1 | * | 10/2020 | ..... B65D 41/3442 |

OTHER PUBLICATIONS

English translation of WO 2020/193821. (Year: 2025).*

* cited by examiner

*Primary Examiner* — James N Smalley

(57) ABSTRACT

The invention refers to a capping device that includes: a lower ring (9) that includes a first section (16) and a second section (17) that are articulated to each other so that the second section (17) pivots with respect to the first section (16), a cap (1); a joint device that connects the cap (1) to the second section (17) of the lower ring (9); including the first section (16) a front area (19) that is suitable and intended to be housed between the support collar (4) and the coupling flange (5) of the neck (2) of the container during the movement of the second section (17) between the lowered position and the released position to allow radial movement of the lower ring (9).

10 Claims, 6 Drawing Sheets

CAPPING DEVICE INTENDED TO BE ATTACHED TO THE NECK OF A CONTAINER

CROSS-REFERENCE TO RELATED APPLICATION

This application is a national stage application, filed under 35 U.S.C. § 371, of International Patent Application No. PCT/EP2022/050327 filed on Jan. 10, 2022, which claims the priority of European application No. 21382010.3 filed Jan. 12, 2021, the contents of which are incorporated by reference.

TECHNICAL FIELD

The invention refers to a capping device that is equipped with a cap and allows keeping the cap attached to the neck of a container, which prevents the cap from being lost forever.

TECHNOLOGICAL BACKGROUND

Document ES1232089U reveals a capping device that includes a lower ring intended to be fixed axially to the neck of a container, a cap that includes a thread intended to fit a supplementary thread made in the neck of the container and an articulation that joins the cap to the lower ring. The lower ring is fitted with coupling means intended to retain the lower ring at the neck of the container. The section of the lower ring that is connected to the cap by the articulation device has no coupling means allowing that section to pivot between a lowered position and a raised position, in particular, to allow the cap to be unscrewed. On the other hand, the cap includes ratchet means intended to cooperate with complementary ratchet means made in the lower ring and thus allow the cap to be held in an open tilted position.

This capping device is not completely satisfactory. Indeed, despite the absence of any coupling means in the section of the lower ring that is connected to the cap by the articulation, handling of the cap to allow the section of the lower ring that is connected to the cap to pivot into a raised position when the cap must move from the open tilted position to the closed position, is not easy.

SUMMARY

An underlying idea of the invention is to propose a capping device that allows keeping a cap attached to the neck of the container that may be reliable, easy to make and use.

According to one embodiment, the invention provides a capping device intended to be attached to the neck of a container that includes an orifice, a support collar and a coupling flange, wherein the capping device includes:

A lower ring fixed axially to the neck and movable in rotation on the neck around that X-axis, including that lower ring a first section, that includes two attachment areas wherein a few engaging elements protrude radially into the lower ring and are intended to be placed below the coupling flange to retain the lower ring axially in the neck of the container, and a second section, with the first section and the second section of the lower ring are articulated to each other so that the second section pivots with respect to the first section between a lowered position wherein the second section is positioned below the coupling flange and a raised position at that the second section is at least partially laid above the coupling flange, a cap that includes an upper wall and an external peripheral skirt, presenting the external peripheral skirt a helical thread intended to cooperate with a helical thread of the neck to allow the movement of the cap between a closing position and a released position in which the helical thread of the cap is no longer engaged with the helical thread of the neck;

a articulation device that joins the cap to the second section of the lower ring and is configured to allow the cap to pivot between the released position and an open tilted position in which the cap is removed from the neck orifice;

including the first section a front area that is diametrically opposed to the second section, with the two engagement areas located respectively on one side and the other of the front area, between that front area and the second section, presenting the front area of the first section at a height lower than the two engagement areas of the first section and the second section, being suitable and intended to be housed between the support collar and the coupling flange during the movement of the second section between the lowered position and the released position to allow a radial movement of the lower ring.

In this way, thanks to the presence of a recess made at the level of the upper edge of the front area of the lower ring that allows additional radial clearance between the lower ring and the neck, the passage of part of the second section to one side and the other of the coupling flange is facilitated. This makes it easier to use the capping device, particularly when the cap must be moved from the open tilted position to the closed position, since the pulling forces to be exerted on the lower ring to allow the second section to move between the lowered position and the raised position are less.

According to other advantageous embodiments, a capping device of this type may have one or more of the following features.

According to one embodiment, the second section lacks engaging elements.

According to one embodiment, the front area of the first section lacks engaging elements.

According to one embodiment, the engaging elements are arranged exclusively in the two engagement areas.

According to one embodiment, the engaging elements are protrusions that protrude radially toward the inside.

According to one embodiment, the front area of the first section extends over an angular range between 40 and 1500 and preferably between 90 and 150°.

According to one embodiment, the second section extends over an angular range between 90 and 180°.

According to one embodiment, each of the two engagement areas extends over an angular range between 10 and 90°.

According to one embodiment, the second section of the bottom ring includes an internal face that has at least one hole. A hole of this type therefore allows the thickness of the second section to be reduced locally to facilitate its passage to both sides of the coupling flange, while maintaining sufficient tear resistance.

According to one embodiment, the internal face of the second section includes two holes that extend respectively from a central area of the second section to one and the other of the two ends of the second section.

According to one embodiment, each hole extends over an angular range greater than 30, advantageously greater than 45° and, for example, in the order of 600.

According to one embodiment, the central area of the second section lacks holes. This allows the second section to retain sufficient rigidity in the area of the locking device to ensure reliable operation of the locking device.

According to one embodiment, at least one hole develops from a lower edge of the second section to an upper portion of the second section intended to be positioned in front of the coupling flange when the second section is in the lowered position.

According to one embodiment, the invention also provides an assembly that includes the capping device mentioned above and a container that includes a neck comprising a orifice, a support collar and a coupling flange arranged axially between the support collar and the coupling flange, the engaging elements of the two lower ring engagement areas are positioned below the coupling flange to retain the lower ring axially at the neck of the container.

According to one embodiment, the height of the front area of the first section is smaller than a gap between the support collar and the coupling flange.

According to one embodiment, the articulation device includes two sheets that connect the external peripheral skirt and the second section.

According to one embodiment, the capping device also includes a locking device configured to lock the cap when it is in the open tilted position, including such locking device a heel that protrudes axially, from the external peripheral skirt, between the two sheets of the articulation device and which includes a stop that protrudes radially to the outside and a protruding portion that protrudes axially from the second section of the lower ring, between the two sheets of the articulation device;

with the stop and the protruding portion configured so that when the cap is in the open tilted position and the second section of the lower ring is in the lowered position, the protruding portion is trapped between the stop and the coupling flange. By virtue of such arrangement, the locking device ensures a robust, wide-angle locking of the cap in its open tilted position. In addition, with respect to a locking device that includes a stop that was configured to go against the neck of the container, the proposed arrangement allows limiting the radial size of the stop. This is particularly advantageous in that a stop having too large a radial size is likely to adversely affect the reliability and performance of bottling operations during which capping devices are transported in particular on conveyors before being placed on the containers.

According to one embodiment, $e1>L-e2$, being:

L: The length of the sheets in an initial state in which the cap is in the closed position;

e1: A radial distance between a contact area of the stop intended to contact the protruding portion when the cap is in the open tilted position and an intersection between a line passing through the upper ends of the sheets and a plane of symmetry (P) of one of the sheets relative to the other; and e2: A radial distance between a contact area of the protruding portion intended to contact the stop when the cap is in the open tilted position and an intersection between a line passing through the lower ends of the sheets and the plane of symmetry (P).

According to on embodiment, $e1>L-e2+e3+e4$, being:

e3: A radial clearance between the lower ring and the neck according to a radial direction to the X-axis and inscribed in the plane of symmetry P; Y e4: a radial clearance between the protruding portion and the coupling flange.

According to one embodiment, $e1=L-e2+e3+e4+\Delta$, being $\Delta$ between 0.05 and 2 mm.

According to one embodiment, the protruding portion protrudes beyond a lower limit of the external peripheral skirt.

According to one embodiment, the sheets and the locking device are configured in such a way that, during the pivoting movement of the cap between the released position and the open tilted position, the sheets are subjected to a tensile force that increases to an intermediate unstable position and then decreases from that intermediate unstable position to the open tilted position.

According to one embodiment, the capping device is molded into one piece.

According to one embodiment, the lower ring is connected to the external peripheral skirt by frangible bridges.

According to one embodiment, when the cap is in the open tilted position and the second section of the bottom ring is in the lowered position, the opening angle of the cap is greater than 120°.

According to one embodiment, the external peripheral skirt includes a recess portion and the elastic sheets are attached to the external peripheral skirt in that recess portion. A configuration of this type allows elastic sheets of sufficient length to be made while limiting the sizes of the interstices made between the cap and the lower ring and capable of allowing the passage of dust.

BRIEF DESCRIPTION OF THE FIGURES

The invention will be better understood and other purposes, details, features and advantages of the invention will be more clearly appreciated in the course of the following description of various particular embodiments of the invention, provided solely as an illustration and not as a limitation, with reference to the attached drawings.

DESCRIPTION OF EMBODIMENTS

In the description and in the figures, the X-axis corresponds to the rotation axis of the cap 1 of the capping device when it is screwed into the neck 2 of the container. By convention, the "radial" orientation is directed orthogonally to the X-axis and the axial orientation is directed parallel to the X-axis. The terms "external" and "internal" are used to define the relative position of one element with respect to another, with reference to the X-axis, thus, an element close to the X-axis is described as internal as opposed to an external element located radially on the periphery.

The terms "upper" and "lower" are used to define the relative position of one element with respect to another, with reference to a position in which the orifice 3 of the neck 2 is directed upwards and the cap 1 is in the closing position on the neck 2 of the container, an element intended to be placed lower being named lower and an element intended to be placed higher being named, upper. The terms "front" and "back" are used to define the relative position of one element with respect to another along a diameter perpendicular to the X-axis.

In relation to FIGS. 1 to 12, an assembly comprising a capping device and a container fitted with a neck 2, shown in FIGS. 1 to 5, is described below.

Figure 2:
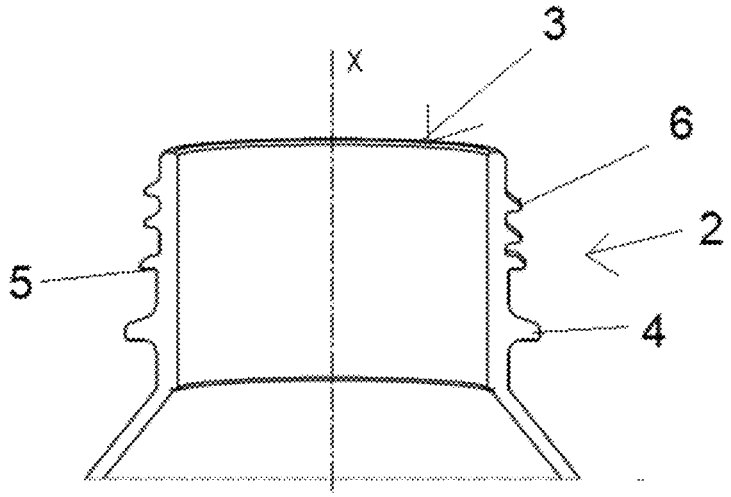
FIG. 2 is a sectional view of a container neck intended to receive the capping device in FIG. 1.

As illustrated in particular in FIG. 2, the neck 2 of the container includes an upper end in which an orifice 3 is formed allowing the contents of the container to be poured. The neck 2 of the container includes a support collar 4 which protrudes radially to the outside and a coupling flange 5 which also protrudes radially to the outside and which is arranged axially between the support collar 4 and the orifice 3. A cylindrical portion is made axially between the support collar 4 and the orifice 3. On the other hand, the neck 2 includes, positioned axially between the coupling flange 5 and the orifice 3, a helical thread 6 formed by a series of helical ribs, which protrude radially outwards from an external surface of the neck 2. The helical thread 6 is intended to cooperate with a complementary helical thread 7, represented in particular in FIG. 4, formed by a series of helical ribs that have been made on the cap 1 of the capping device.

According to one embodiment, the helical thread 6 made on the neck 2, as well as the helical thread 7 made on the cap 1 are interrupted. In other words, the adjacent helical ribs are separated by a space that forms a vent and allows, in particular, evacuating the gas present inside the container while the cap 1 is still attached at the neck 2.

Figure 1:
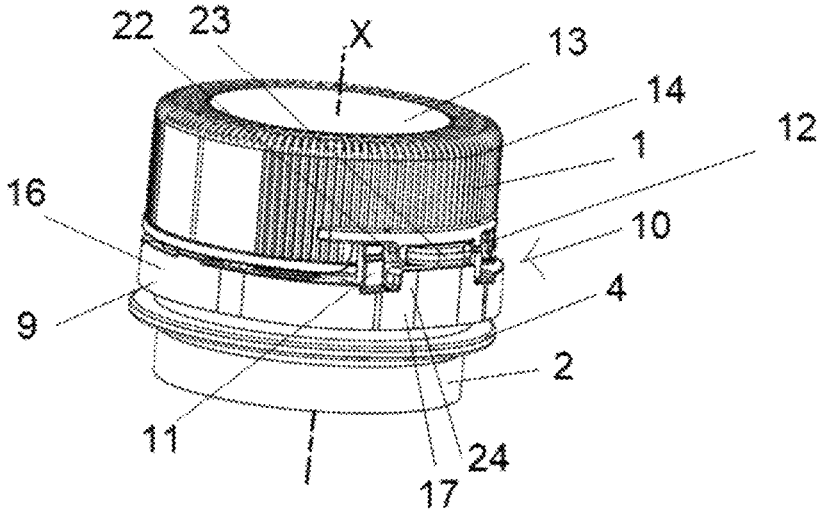
FIG. 1 is a three-quarter rear perspective view of a capping device mounted on the neck of a container.

The capping device includes a lower ring 9 which is retained in the neck 2 of the container, a cap 1 which is intended to cover the orifice 3 of the container for sealing and an articulation device 10, represented in particular in FIG. 1 that attaches the cap 1 to the lower ring 9. The cap 1 is movable between a closing position, shown in FIG. 1 and a released position, shown in FIG. 3, in which, the cap 1 is no longer engaged with the neck 2. The cap 1 is also suitable for tilting from the released position toward the open tilted position, shown in FIGS. 4 and 5, in which the cap 1 is removed from the orifice 3 of the neck 2 so as not to hinder the pouring of contents of the container. The capping device also includes a locking device arranged to lock the cap 1 in the open tilted position.

As shown in particular in FIG. 1 the cap 1 includes an upper wall 13 intended to be placed substantially orthogonal to the X-axis, opposite the orifice 3 of the neck 2 when said cap 1 is in the closing position. The cap 1 additionally includes an external peripheral skirt 14 intended to surround the neck 2 of the container when the cap 1 is in the closed position. The external peripheral skirt 14 extends, downwards, perpendicular to the upper wall 13, from the external periphery of said upper wall 13. The helical thread 7 is made on the inner face of the outer peripheral skirt 14.

Figure 4:
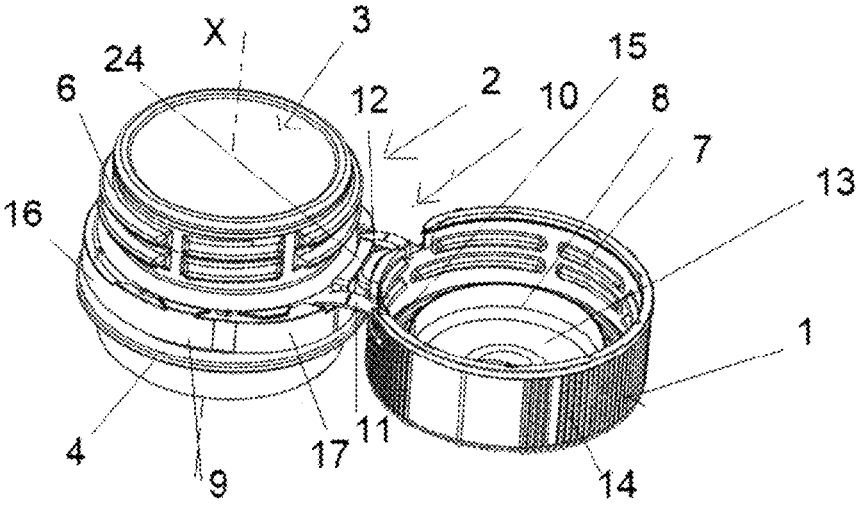
FIG. 4 is a perspective view of the capping device mounted on the neck of the container and representing the cap of the capping device in an open tilted position where the cap is removed from the neck orifice.

As represented in particular in FIG. 4, the cap 1 includes an internal skirt 8, which extends perpendicularly downwards from the upper wall 13 of the cap 1 and is sized to be inserted into the interior of the orifice 3 of the neck 2. The cap 1 also includes an annular lip 15 that extends, from the upper wall 13, radially between the internal skirt 8 and the external peripheral skirt 14. The inner skirt 8 and annular lip 15 are sized in such a way that, when the cap 1 is in the closed position, in the neck 2 of the container, the inner skirt 8 is in contact against the inner face of the neck 2 while the annular lip 15 is in contact with the outer face of the neck 2. In this way, the internal skirt 8 and the annular lip 15 ensure the tightness of the closure.

Figure 7:
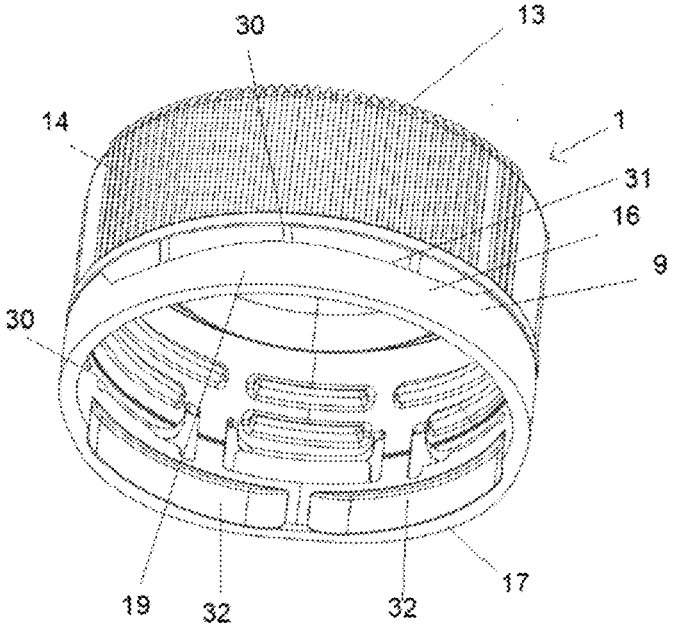
FIG. 7 is a perspective view from below of the capping device that illustrates the inner face of the second section of the bottom ring.
Figure 8:
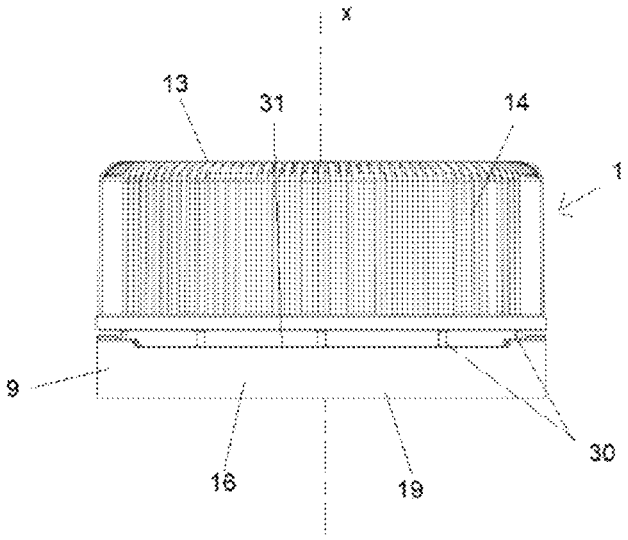
FIG. 8 is a front view of the capping device.
Figure 9:
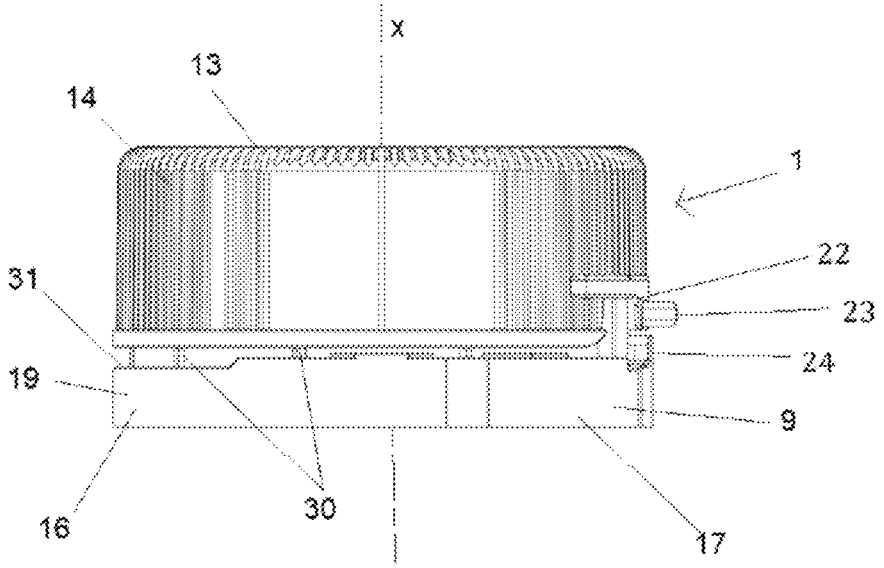
FIG. 9 is a side view of the capping device.

Advantageously, the lower ring 9 is, before the container is opened for the first time, connected to the cap 1 by frangible bridges 30, visible, for example, in FIGS. 7 to 9, intended to break during the opening of the cap 1. These frangible bridges 30 thus constitute tamper-evident seals.

Figure 3:
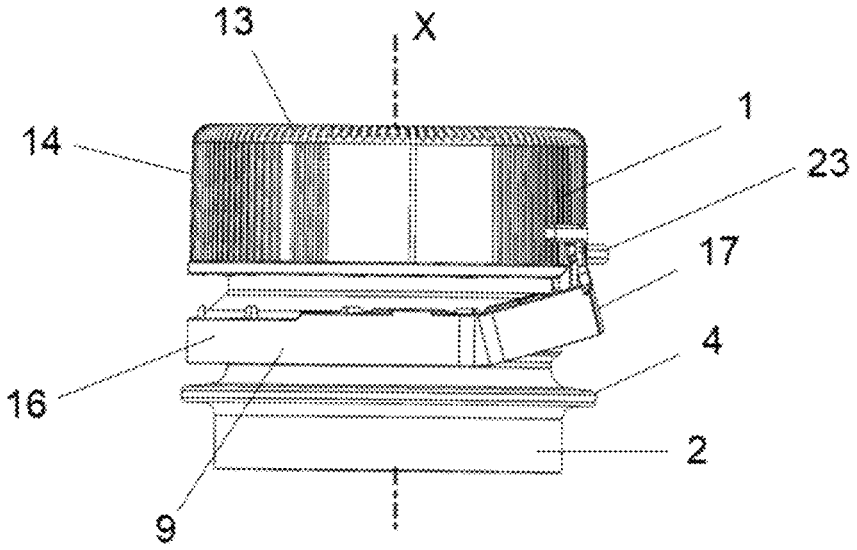
FIG. 3 is a side view of the capping device mounted on the neck of the container and representing the cap of the capping device in a released position wherein it is no longer engaged with the neck of the container.

The lower ring 9 is held axially at the neck 2 of the container while it can rotate relative to the container around X-axis. As depicted in FIGS. 1 3 and 4, the lower ring 9 includes two parts that are articulated to each other, namely, a first section 16 and a second section 17 by which the lower ring 9 is attached to the cap 1 by means of the articulation device 10.

As shown in FIG. 3, the second section 17 is suitable for pivoting upwards with respect to the first section 16, between a lowered position where at least most of the second section 17 is intended to be arranged below the coupling flange 5 and a raised position, in which at least most of the second section 17 is arranged above the coupling flange 5. This allows the cap 1 to move upwards with respect to the neck 2 of the container, until the helical thread 7 of the cap 1 is disengaged from the helical thread 6 made on the neck 2 of the container. In other words, when the cap 1 is unscrewed, the lower ring 9 is dragged in rotation around the X-axis while the second section 17 of the lower ring 9 pivots with respect to the first section 16 to the raised position to allow an axial movement, upwards the cap 1 from the closed position, to the released position, shown in FIG. 3. When the cap 1 pivots from the released position toward the open tilted position, the second section 17 of the lower ring 9 pivots in the opposite direction with respect to the first section 16 and then returns to the lowered position. On the other hand, the second section 17 also pivots with respect to the first section 16 from the lowered position to the raised position when the cap 1 pivots from the open tilted position to the released position.

The lower ring 9 is held axially in the neck 2 of the container by means of the coupling flange 5. As shown in FIG. 2, the coupling flange 5 has a round-shaped outer surface that narrows upwards, i.e. toward the orifice 3 of the container. The coupling flange 5 delimits, downwards, that is, in a direction opposite to orifice 3, a protrusion.

Figure 6:
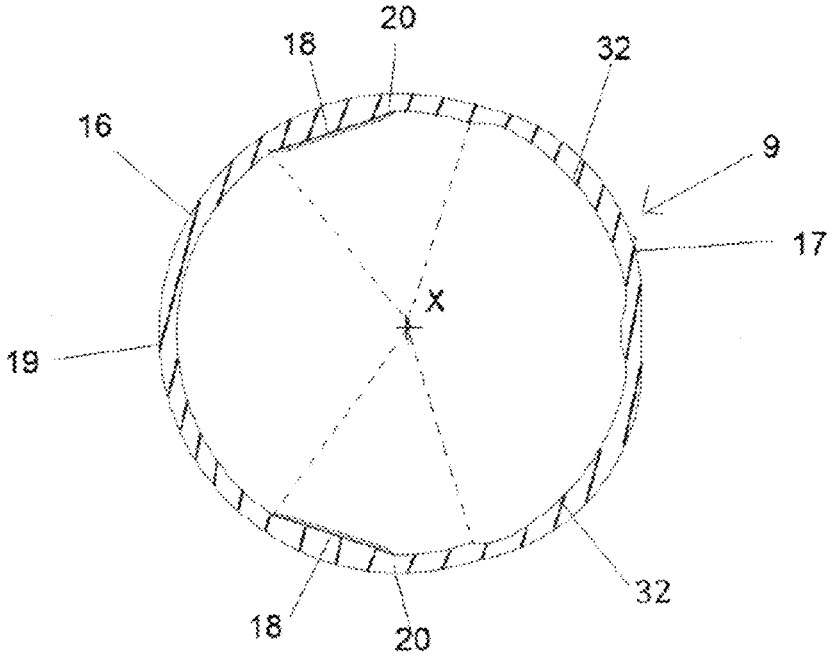
FIG. 6 is a sectional view of the lower ring of the capping device in a plane orthogonal to the X-axis

As shown in FIG. 6, the first section 16 of the lower ring 9 includes some engaging elements 18 which are intended to cooperate with the coupling flange 5 made on the container in order to retain axially the lower ring 9 to the neck 2 of the container. The engaging elements 18 are protrusions which protrude radially inwards from the first section 16 of the lower ring 9. Advantageously, the engaging elements 18 have a radial size that increases, from the bottom up, that is, in the direction of the upper edge of the lower ring 9. During the assembly of the capping device on the neck 2 of the container, the engaging elements 18 are slid against the frustoconical surface of the coupling flange 5 and then immobilized by an elastic return behind the coupling flange 5.

The first section 16 of the lower ring 9 includes a front area 19 which is diametrically opposite to the second section 17 of the lower ring 9 and two engagement areas 20, represented in FIG. 6, which are arranged on either side of the front area 19 and are each arranged between the front area 19 and the second section 17 of the lower ring 9. The engaging elements 18 are arranged exclusively in the two engagement areas 20, 21. Thus, due to the absence of engaging elements 18 in the front area 19 of the first section 16, there is a radial clearance between the lower ring 9 and the neck 2 that allows the lower ring 9 to move from front to back and vice versa. This allows a portion of the second section 17 to be easily moved to one side of the coupling flange 5 during the movement of the second section 17 between the lowered position and the raised position. In other words, the tensile forces to be exerted on the lower ring 9 to allow the second section 17 to pass to one side and the other of the coupling flange 5 are less.

Advantageously, the second section 17 extends over an angular range between 90 and 150° and, for example, in the order of 120°, the front area of the second section 16 extends over an angular range between 90 and 150°, for example, in the order of 120°, while each of the two engagement areas 20, 21 extends over an angular range between 30 and 90°, for example, in the order of 600.

Figure 5:
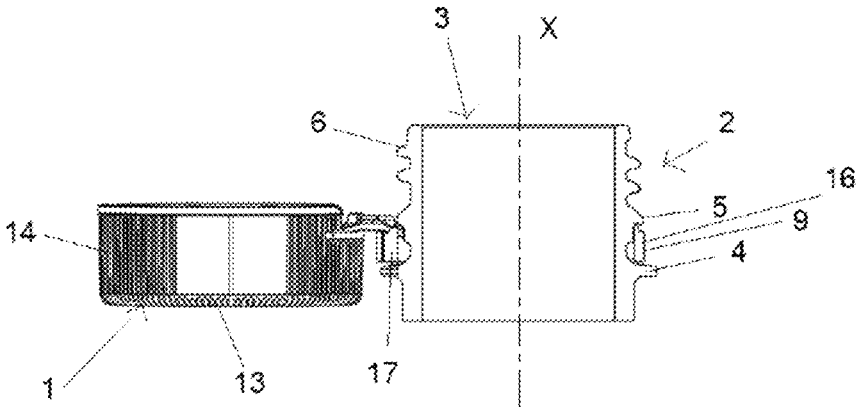
FIG. 5 is a sectional view of the capping device mounted on the neck of the container and representing the cap of the capping device in an open tilted position where the cap is removed from the neck orifice.

As represented in particular in FIGS. 8 and 9, the front area 19 of the first section 16 has a recess 31 made at the level of the upper edge of the lower ring 9. Thus, the front area 19 has a height, measured parallel to the X-axis, that is smaller than that of the lower ring 9, outside the front area 19 and that is smaller than the gap between the support collar 4 and the coupling flange 5. This allows the radial clearance between the lower ring 9 and the neck 2 to be further increased since, as illustrated in FIG. 5, this recess 31 allows the front area 19 of the first section 16 to be positioned axially between the support collar 4 and the coupling flange 5 while, in the absence of such recess 31, the front area would be supported against the coupling flange 5.

An arrangement of this type is also advantageous because it makes it easier to ascertain whether the frangible bridges 30 have already broken when the cap 1 is opened for the first time, since as soon as the frangible bridges 30 have broken and, consequently, the lower ring 9 is no longer connected to the stop 9 except by means of the articulation device 10, the lower ring 9 leans forwards, thus facilitating the verification of the opening violation status. In addition, the lower ring 9 may thus have, outside the front area, a height higher than the gap between the support collar 4 and the coupling flange 5, allowing the sizes of the interstices to be limited, made between the cap 1 and the lower ring 9 and susceptible to dust passage.

Moreover, as an alternative or in addition to the recess 31 described above, the second section 17 of the lower ring 9 also has particular features that allow the passage of a part of the second section 17 to one side and the other of the coupling flange 5 during the movement of the second section 17 between the lowered position and the raised position. As shown in FIGS. 6 and 7, the second section 17 of the lower ring has two holes 32 that are made on the internal face of that second section 17. The holes 32 extend respectively from a central area of the second section 17 to one and the other of the two ends of the second section 17.

In addition, holes 31 develop from the lower edge of the lower ring to a top portion of the second section 17 of the lower ring 9 which is intended to face the coupling flange 5 when the second section 17 is in the lowered position. These holes 31 are intended to locally reduce the thickness of the second section 17 in order to facilitate its passage to both sides of the coupling flange 5 while retaining sufficient tear resistance.

As for the central area of the second section 17 it has no holes, which allows the second section 17 of the lower ring 9 to retain sufficient rigidity to allow reliable operation of the locking device described below.

In the embodiment shown, the articulation device 10 includes two sheets 11, 12, particularly visible in FIGS. 1 and 4, which connect the cap 1 and, more particularly, the outer peripheral skirt 14 of the cap 1 to the lower ring 9, and more particularly, the outer peripheral skirt of the cap to the lower ring, and more particularly, to the second section 17 of the lower ring 9. Sheets 11, 12 are symmetrical to each other with respect to a plane of symmetry P, represented in FIGS. 11 and 12, which is vertical and passes along the X-axis Sheets 11, 12 are attached to the external peripheral skirt 14 in a recessed portion. Likewise, the sheets 11, 12 are advantageously joined to the second section 17 of the lower ring 2 in a low-cut portion. In other words, sheets 11, 12 extend substantially above the lower limit of the outer peripheral skirt 9 and extend substantially below the upper limit of the lower ring 3.

The locking device includes a heel 22, particularly visible in FIG. 1 which is made on the outer peripheral skirt 14 of the cap 1. The heel 22 protrudes axially downwards, that is, in the direction of the lower ring 9, from the outer peripheral skirt 14 of the cap 1. The heel 22 protrudes between the two sheets 11, 12. The heel 22 includes a stop 23 that extends circumferentially between the two sheets 11, 12 and that protrudes radially outwards from the heel 22.

The locking device also includes a protruding portion 24 which protrudes axially upwards, i.e. toward the external peripheral skirt 14 of the 1 cap from the second section 17 of the lower ring 9. The protruding portion 24 also protrudes between the two sheets 11, 12.

As shown in FIGS. 4 and 5, the stop 23 and the protruding portion 24 are arranged in such a way that, when the cap 1 is in the open tilted position, the protruding portion 24 is interspersed between the stop 23 and the coupling flange 5. In other words, when the cap is in the open tilted position, the stop 23 and the protruding portion 24 are in contact with each other in an area located in the plane of the coupling flange 5 and the protruding portion 24 is also in contact against the coupling flange 5.

Figure 11:
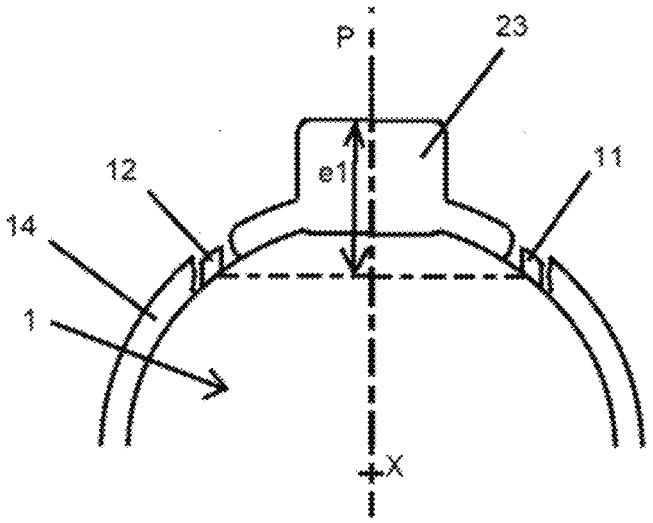
FIG. 11 is a cross-sectional schematic representation of the cap and stop.
Figure 12:
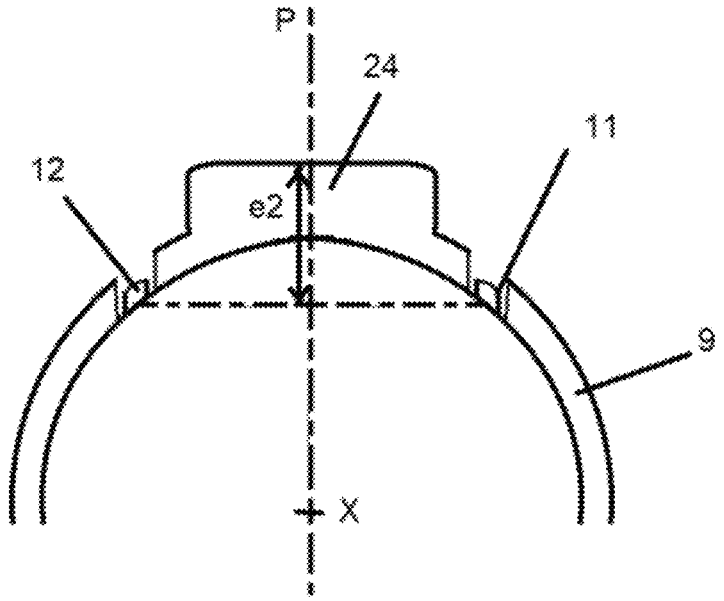
FIG. 12 is a schematic representation in section of the lower ring and the protruding portion.

As shown in FIGS. 11 and 12, respectively, the contact area of the stop 23 with the protruding portion 24 is positioned at a radial distance e1 from the intersection between the line passing through the upper ends of the sheets 11, 12 and the plane of symmetry P and the contact area of the protruding portion 24 with the stop 23 is positioned at a radial distance e2 from the intersection between the line passing through the lower ends of the sheets 11, 12 and the symmetry plane P.

Size e1 is such that e1>L−e2, with L: the length of the sheets 11, 12, in the initial state, when the cap is in the closed position. This ensures that the stop 23 contacts the protruding portion 24 and that the sheets 11, 12 are tensioned by traction when the cap 1 is in the open tilted position.

Additionally, e1>L−e2+e3+e4, with e3 being: The radial clearance between the protruding portion 24 and the coupling flange 5 and e4: The radial clearance between the lower ring 9 and the neck 2 according to the front/back direction, that is, according to a radial direction to the X-axis and inscribed in the plane of symmetry P. Preferably, e1=L−e2+e3+e4+A, being Δ between 0.05 and 2 mm, and determined so that the protruding portion 24 contacts against the coupling flange 5 when the cap 1 is in the open tilted position.

Figure 10:
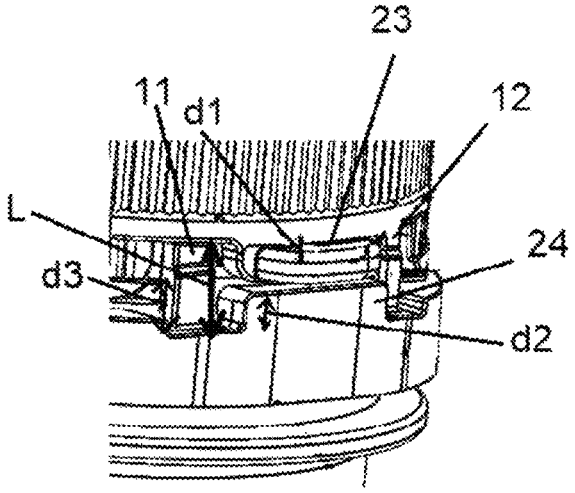
FIG. 10 is an extension of FIG. 1 which illustrates the locking device in detail.

Moreover, as shown in FIG. 10, when the cap 1 is in the closed position, the upper edge of the contact surface of the stop 23 extends axially below the upper end of the sheets 11, 12 at a distance d1, the upper edge of the protruding portion 24 extends axially above the lower end of sheets 11, 12 at a distance d2 and the upper edge of the coupling flange 5 extends axially above the lower end of sheets 11, 12 at a distance d3. Advantageously, the distance d1 is smaller than d2 and d3.

The kinematics of cap 1 is as follows. During the first unscrewing, the cap 1 leaves the closed position and moves away from the lower ring 9 to the released position, illustrated in FIG. 3. The frangible bridges are broken in the course of this movement. Additionally, during this unscrewing movement of the 1 cap the lower ring 9 is dragged in rotation around the X-axis and the second section 17 of the lower ring 9 pivots toward the raised position as the cap 1 moves away from the coupling flange 5.

The cap 1 can then pivot backwards in the direction of the open tilted position in which the external peripheral skirt 14 extends upwards from the upper wall 13. During the movement of the cap 1 backwards in the direction of its open tilted position, the stop 23 rests against the protruding portion 24 and therefore causes the second section 17 of the lower ring 9 to pivot from the raised position to the lowered position.

The possibilities of stretching of sheets 11, 10 together with the above mentioned features of the locking device, allow creating a hard point during the inclination of the cap 1 between the released position, represented in FIG. 3, and the open tilted position, represented in FIGS. 4 and 5. In other words, the sheets 11, 12, as well as the locking device are configured in such a way that, during a first part of the movement of the cap 4 from the released position toward the open tilted position, the two elastic sheets 28, 29 are, due to the support of the stop 23 on the protruding portion 24, subjected to a tensile force that increases to an intermediate unstable position and then decreases from that intermediate unstable position to the open tilted position. This allows the cap 1 to be locked in the open tilted position.

As shown in FIGS. 5 and 6, when the second section 17 of the lower ring 9 is in the lowered position and the cap 1 is in its open tilted position, the stop 23 is supported against the protruding portion 24 which, in this way, is sandwiched between that stop 23 and the coupling flange 5.

This way, the cap 1 remains in its open tilted position because, due to the arrangement mentioned above, cap 1 cannot be pivoted to the released position in which the cap 1 faces distribution orifice 3 while the second section 17 of lower ring 9 remains in the lowered position.

Advantageously, when the cap 1 is in its open tilted position and the second section 17 of the lower ring 9 is in the lowered position, the opening angle of the cap 1 is greater than 120° and, advantageously, greater than or equal to 145° and, for example, in the order of 180°. The opening angle corresponds to the protruding angular section that is formed at the intersection between a plane parallel to the top wall 13 of the cap 1 and a horizontal plane.

To close the cap 1 again the user tilts the cap 1 forward to the released position. During this tilt, contact between stop 23 and protruding portion 24 disappears, allowing the second section 17 of lower ring 9 to move into the raised position.

When the second section 17 is in the raised position and the cap 1 is in the released position, the cap 1 can then be screwed back into the neck 2 of the container. During threading, the lower ring 9 is dragged in rotation around the X-axis and the second section 17 of the lower ring 9 pivots toward the lowered position as the cap 1 approaches the coupling flange 5.

Advantageously, the capping device assembly is molded into a single piece of synthetic material, such as polyethylene and advantageously high density polyethylene. Advantageously, the capping device is molded in the configuration of FIG. 1, i.e. in a closed position, a position in which it can be mounted directly on the neck 2 of the container.

Although the invention has been described in relation to several particular embodiments, it is more than evident that it is not in any way limited to these and that it comprises all the technical equivalents of the described means, as well as their combinations if they fall within the scope of invention.

The use of the verb "to consist of", "to comprise" or "to include" and their conjugated forms do not exclude the presence of elements or stages other than those mentioned in a claim.

In the claims, any reference sign in parentheses is not to be interpreted as a limitation of the claim.

The invention claimed is:

1. A capping device intended to be attached to a neck of a container that includes an orifice, a support collar and a coupling flange, including the capping device:

a lower ring fixed axially to the neck and movable in rotation on the neck around that X-axis, including this lower ring a first section that includes two engagement areas in which engaging elements protrude radially toward the inside of the lower ring and are intended to be placed under the coupling flange to retain axially the bottom ring on the neck of the container and a second section, with the first section and the second section of the lower ring articulated to each other so that the second section pivots with respect to the first section between a lowered position in which the second section is arranged below the coupling flange and a raised position in which the second section is arranged at least partially above the coupling flange, a cap including an upper wall and an external peripheral skirt, presenting the external peripheral skirt a helical thread intended to cooperate with a helical thread of the neck to allow the movement of the cap between a closed position and a released position in which the helical thread of the cap is no longer present coupled with the helical thread of the neck ring;

an articulation device that joins the cap to the second section of the lower ring and is configured to allow the cap to pivot between the released position and an open tilted position in which the cap is removed from the orifice of the neck;

including the first section a front area which is diametrically opposed to the second section, with the two engagement areas located respectively on one side and the other side of the front area, between that front area and the second section, presenting the front area of the first section a height lower than the two engagement areas of the first section and the second section and being configured to fit between the support collar and the coupling flange during the movement of the second section between the lowered position and the released position to allow radial movement of the lower ring, wherein the second section of the lower ring includes an internal face having at least one hole.

2. The capping device according to claim 1 wherein the front area of the first section extends over an angular range between 4° and 150°.

3. The capping device according to claim 1, wherein the internal face of the second section includes two holes extending respectively from a central area of the second section to one and the other two ends of the second section.

4. The capping device according to claim 1, wherein the central area of the second section lacks holes.

5. The capping device according to claim 1, in which at least one hole develops from a lower edge of the second section to an upper portion of the second section intended to be placed in front of the coupling flange when the second section is in the lowered position.

6. A set including a capping device according to claim 1 and a container including a neck comprising a orifice, a support collar and a coupling flange arranged axially between the support collar and the coupling flange, when the engaging elements of the two engagement areas of the lower ring are positioned below the coupling flange to retain the lower ring axially in the neck of the container, the height of the front area of the first section is smaller than a gap between the support collar and the fastening flange.

7. The assembly according to claim 6, wherein the articulation device includes two sheets connecting the outer peripheral skirt and the second section, including the capping device a locking device configured to lock the cap when in the open tilted position, including the locking device a heel protruding axially, from the outer peripheral skirt, between the two sheets of the articulation device and which includes a stop that protrudes radially to the outside and a protruding portion that protrudes axially from the second section of the lower ring, between the two sheets of the articulation device;

with the stop and the protruding portion configured so that when the cap is in the open tilted position and the second section of the lower ring is in the lowered position, the protruding portion is pinched between the stop and the coupling flange.

8. The assembly according to claim 7, wherein e1>L−e2, being:

L: The length of the sheets in an initial state in which the cap is in the closed position;

e1: a radial distance between a contact area of the stop intended to contact the protruding portion when the cap is in the open tilted position and an intersection between a straight line passing through the upper ends of the sheets (and a plane of symmetry of one of the sheets with respect to the other; and e2: a radial distance between a contact area of the protruding portion intended to contact the stop when the cap is in the open tilted position and an intersection between a straight line passing through the lower ends of the sheets and the plane of symmetry.

9. The assembly according to claim 8, wherein e1>L−e2+e3+e4, being:

e3: A radial clearance between the lower ring and the neck in a radial direction to the X-axis and inscribed in the plane of symmetry P; and e4: a radial clearance between the protruding portion and the coupling flange.

10. The assembly according to claim 9, wherein e1=L−e2+e3+e4+Δ being Δ between 0.05 and 2 mm.

* * * * *